US008157925B1

(12) United States Patent
Templin

(10) Patent No.: US 8,157,925 B1
(45) Date of Patent: Apr. 17, 2012

(54) SIPHON ADAPTED FOR CLEANING VESSELS

(76) Inventor: Mark D. Templin, Fergus Falls, MN (US)

( * ) Notice: Subject to any disclaimer, the term of this patent is extended or adjusted under 35 U.S.C. 154(b) by 851 days.

(21) Appl. No.: 11/560,615

(22) Filed: Nov. 16, 2006

(51) Int. Cl.
*B08B 3/00* (2006.01)
*B08B 9/00* (2006.01)

(52) U.S. Cl. ..... 134/166 R; 134/167 R; 134/168 R; 134/168 C; 134/167 C

(58) Field of Classification Search ..... None
See application file for complete search history.

(56) References Cited

U.S. PATENT DOCUMENTS

| | | | | |
|---|---|---|---|---|
| 3,645,452 | A | 2/1972 | Stoeckel et al. | |
| 4,722,670 | A | 2/1988 | Zweifel | |
| 4,943,211 | A | 7/1990 | Boegh | |
| 5,133,484 | A | 7/1992 | Globert et al. | |
| 5,152,026 | A | 10/1992 | Scarpine | |
| 5,167,046 | A | 12/1992 | Benson | |
| 5,322,222 | A | 6/1994 | Lott | |
| 5,556,259 | A | 9/1996 | Hlavenka | |
| 5,603,775 | A * | 2/1997 | Sjoberg | 134/21 |
| 5,695,654 | A * | 12/1997 | Schultz | 210/780 |
| 6,261,067 | B1 | 7/2001 | Popov | |
| 6,269,800 | B1 | 8/2001 | Fischerkeller et al. | |
| 6,471,489 | B2 | 10/2002 | Hua | |
| 6,517,320 | B1 | 2/2003 | Reynolds | |
| 6,537,036 | B1 | 3/2003 | Broerman et al. | |
| 6,547,532 | B2 | 4/2003 | Gonzalez et al. | |
| 6,575,705 | B2 | 6/2003 | Akiyama et al. | |
| 6,783,334 | B2 | 8/2004 | Sanderson et al. | |
| 6,904,769 | B2 | 6/2005 | Ogata et al. | |

* cited by examiner

*Primary Examiner* — Michael Barr
*Assistant Examiner* — Jason Ko
(74) *Attorney, Agent, or Firm* — Albert W. Watkins

(57) ABSTRACT

A siphon is adapted for thoroughly cleaning fluid vessels such as recreational vehicle water heaters. The siphon is capable of elevating discharge waste fluid to water heads greater than a water head present within the recreational vehicle water heater through the a transfer of kinetic energy provided by a pressurized fluid source, thereby obviating any need for undesirable electrical, chemical, or other mechanical power sources. An inlet couples pressurized fluid from the pressurized fluid source. A divider splits the pressurized fluid between a jet port outlet and a tank flush source conduit. A variety of different cleaning attachments may be selected to terminate the tank flush source conduit. A siphon return conduit is in one preferred embodiment concentrically arranged about the tank flush source conduit and is operative to carry waste fluid from the recreational vehicle water heater, with the cleaning attachment protruding from the siphon return conduit. By slightly protruding, the cleaning attachment operatively blocks the siphon return conduit from being held by siphon vacuum against a surface of the fluid vessels and containers. A drain conduit is provided, as is a mixing chamber at a junction between the jet port outlet and an outlet from the siphon return conduit.

13 Claims, 4 Drawing Sheets

SIPHON ADAPTED FOR CLEANING VESSELS

BACKGROUND OF THE INVENTION

1. Field of the Invention

The present invention pertains generally to the cleaning of vessels, and more particularly to an improved siphon capable of dislodging residue and pumping the resulting liquid and residue mixture from the vessel. The teachings of the present invention are illustrated in a most specific and advantageous manifestation as a tool for cleaning recreational vehicle water heaters.

2. Description of the Related Art

Whenever a group of people gather and discuss the inventions that have had the most profound effect on the world, at least one old-timer that remembers the early days will suggest that indoor plumbing should be considered as one of the most profound. What we take for granted today was extremely important to the development of our modern society, bringing not only great convenience and time-savings, but also very greatly advancing the health and welfare of the population. With plumbing and the sanitation that was derived directly therefrom, densely populated cities have been able to develop and thrive, while remaining free of what used to be very common ailments and diseases. A large number of more specific improvements have continued to occur over time, further advancing the utility of plumbing. These advances have further improved health, welfare, convenience, aesthetic appearance, and other beneficial areas.

One such noteworthy improvement is the modern capability to transport a fully self-contained plumbing system, wherever modern man travels. Not only is fresh drinking water transported and provided through a safe and convenient faucet and pressurized line, but in many additional instances, such as within a recreational vehicle (RV) or the like, there will also be a waste storage system and a water heater. The water heater provides a limited amount of hot water on demand, often used by a person for various cleansing tasks, cooking and consumption.

Another noteworthy improvement in the plumbing industry has been the use of copper as the material for fresh-water pipes. Copper is advantageously used for the freshwater lines since it provides important biocidal activity, inhibiting the growth of bacteria, yeast, fungi and algae. Even when ion exchange occurs between impurities in the water and the copper, the copper will remain bio-active. The bio-activity will continue, so long as a sludge or film has not isolated copper ions from the water. Furthermore, even when leached into the water in the low quantities as occurs in such a plumbing system, copper is non-toxic. Consequently, water may be retained within copper pipes for reasonable durations within a plumbing system without becoming odorous or toxic.

Unfortunately, many of the portable systems described herein above, including those with water heaters, sit idle for many months at a time. A recreational vehicle may be used for only a few weeks or months out of a year, the rest of the time remaining parked. Even if the water within the pipes were to remain suitable, a water heater presents a very different environment.

The unique environment within a water heater, when compared to ordinary pipes and pumps, comes with elevated temperatures and the containment of a large relatively stagnant volume of water. Within the containment of the water heater vessel, it is quite common for sludge and particulate to precipitate. As the water heater ages, rust, scale and other impurities continue to deposit and accumulate on the walls and adjacent to the bottom. The minerals, rust flakes, and other contaminants can literally fill the bottom of the tank.

The deposits form both a thermal barrier to the introduction of heat, either through the vessel walls in the case of a gas heater, or from the element into the liquid in the case of an electric heater. The precipitate also forms a mass which is not biocidal and which can therefore sustain the growth of offensive and potentially toxic microbes. Any standing water which sits for durations measured in months within a water heater vessel will consequently tend to foul, and present with an associated unpleasant odor. In some instances, it is also possible for the impurities to corrosively interact with the tank, and thereby accelerate local corrosion. Furthermore, as is known, as these sediments accumulate the water heat will lose operational efficiency and will also likely fail earlier.

The extended periods and the accumulation of sludge and other materials common to a water heater will lead to fouling of the water and generation of offensive odor, the contents which is not readily flushed from the plumbing system. Copper, which exhibits biocidal activity, is somewhat more expensive than other alternative materials, and not widely used in water heaters. Nor is this biocidal activity sufficient to overcome the sludge and precipitates. Other materials have been used within plumbing systems through time, and iron plumbing is also relatively commonplace, as are various iron alloys and coated or plated steel. Plated steel offers an excellent compromise between cost and corrosion resistance, and so is commonly used. None of the ferrous materials exhibit substantial biocidal activity. Polymers such as polyvinylchloride and others have been used within plumbing systems, but these polymers do not provide any biocidal activity, and instead are now known to be prone to the formation of harmful biofilms. Furthermore, the polymers also do not readily conduct thermal energy, and so are undesirable for use in combustion-type water heaters, such as gas water heaters. In addition, no reasonably-priced polymers exist which may be safely used as the containment vessel within a water heater. Consequently, most plumbing systems prefer to use polymer plumbing only for waste-conveyance. Finally, some of the most expensive systems rely on stainless-steel alloys. These are far less common, owing to the cost, and like the steel counterparts offer far less biocidal activity than copper. In the end, it is just not plausible or practical through materials science to provide a water heater vessel material which is reasonably priced, safe for potable water supplies, and also sufficiently biocidal to preserve the high-impurity content water found within a heater vessel for extended periods.

While copper pipes are more likely to preserve the water, and are readily easily flushed simply by running fresh water through for a brief time period, the same is not true for the tanks. When preparing such a tank for the next use, a person is forced to run a great deal of water to remove the residue from the tank. Consequently, a great deal of time and effort is spent not only with desirable draining, but in the flushing of the tank and associated preparation immediately before use. This time is in distinct contradiction to the primary benefit of a recreational vehicle, which is the "ready-for-travel" nature of such a fully-equipped vehicle.

To protect the water systems from damage due to freezing, or simply to prepare the plumbing system for extended storage, water lines and the water heater are commonly drained. This may at first blush appear to provide the solution to longer term storage. However, while water lines often may be fully drained, many water heaters will still retain a small amount of water adjacent to the bottom of the vessel. This remnant water adjacent the bottom of the tank is invariably the most highly contaminated water within the tank, where the most material has been deposited. With the prior art techniques for draining, these water heaters will foul even when drained. As may be apparent, no viable and effective solution exists to leaving an RV water heater idle for extended periods, even though this is typical for most recreational vehicles so equipped.

While portable plumbing systems such as found in recreational vehicles have been primarily discussed, many of the same issues arise with plumbing systems found in geographically static structures such as buildings and houses. In particular, it is quite common to accumulate a great deal of scale, precipitate and other deposits within a water heater. Like the RV counterpart, many water heaters do not provide a ready way to fully and completely open and clean the interior of the water vessel. Instead, most commercially available water heaters, RV or otherwise, are fitted with some type of drain valve to which a hose may be coupled. The opening into the water heater is frequently quite small and restricted, preventing most persons from accessing the interior of the vessel. These openings are also most commonly slightly above the lowest point within the vessel. Once again then, cleaning is greatly inhibited, with the owner relying primarily upon flushes of smaller suspended particulate. The larger particulate and sludge remain within the tank. In the case of most home water heaters however, there are rarely times where water will remain stagnant for extended intervals. Consequently, it is much less common for there to be any issue with an accumulation of biofilms or microorganisms, or the development of offensive odor.

Potable water systems are not the only plumbing systems which could benefit from a more thorough cleaning than was heretofore possible. Consequently, a review of other systems is also appropriate, though other than the references made in the present disclosure these systems may share little or nothing in common, nor provide any teachings to those skilled in the art of water heaters. One feature which is important with respect to the present invention and the teachings found herein is the presence of a water vessel within which undesirable contaminants may be found, and for which there does not exist an optimum way to thoroughly clean and flush the system. Such systems are found not only in water heaters but in some cooling systems, aquariums, swimming pools and swimming pool filters, and many other systems.

To clean such systems, it is known to introduce fresh water into the system while simultaneously siphoning off water containing the undesirable contaminants, impurities or particulates. One example of known siphon-type cleaning systems is found in U.S. Pat. No. 6,517,320 by Reynolds, entitled "Hose siphon," the contents and teachings which are incorporated herein by reference. The Reynolds invention is designed for cleaning a swimming pool sand filter, and illustrates a fresh water faucet inlet split between a cleaning line and a siphon priming line, the cleaning line and a siphon drain line entering into the swimming pool sand filter, and a junction between the siphon priming line and the drain line. The turbulence created within the filter is intended to entrain the sand or other debris, and permit the debris to then be carried through the siphon line to some discharge point. However, because the Reynolds invention uses separate lines for cleaning and siphoning, the size of these lines is undesirably limited to an undesirably small percentage of the cross-sectional area available for a given opening. Furthermore, the ability to manipulate these lines is quite limited, other than controlling the depth of insertion into the filter. For a sand filter, the depth may be the only factor of interest. However, in the case of other vessels where sediment, films and other deposits may accumulate at any level or elevation within the vessel, simply creating turbulence at the bottom will be inadequate.

The separation of control valves from adjacent the water vessel opening is also inconvenient in the Reynolds invention, requiring the operator somehow monitor the operation at a distance. Once again, this may be irrelevant in the case of a sand filter, where an overflow of the filter might be relatively inconsequential. However, in the case of a water heater with only limited space between drain outlet and the bottom of the heater, and the likelihood that leakage from the water heater could damage adjacent furnishings or finished surfaces such as floors, floor coverings, or other furniture or appliances, it would be very desirable to be able to simultaneously control both the operation of the siphon and also the fresh water inlet. The operator will also have to closely monitor the siphon hose, to ensure that within the turbulent water the siphon inlet does not wander into a surface within the vessel and then remain held there by the siphon vacuum.

Finally, the Reynolds patent illustrates a siphon-priming valve which is displaced from the convergence with the siphon line, and which evidently is only suitable for priming. This is due to the fact that water exiting from 17a will be flow-limited by the valve, and then will accumulate within line 9, consequently losing nearly all kinetic energy. In other words, the Reynolds siphon is only able to siphon liquid to a point lower than the level of water within the sand filter. Once again, in the case of a swimming pool sand filter, this may be generally adequate. Nevertheless, this undesirably limits the available application to above-ground sand filters or to sand filters with a readily accessible nearby drain into which the siphon hose may be inserted. In contrast to the sand filter, a water heater commonly is located such that the drain opening is only a few inches above the ground level. In such cases, it may be difficult or impossible to initiate and sustain a suitable siphon into a suitable receptacle or available drain.

A similar though somewhat more basic combination of a spray line and a siphon line entering into a swimming pool sand filter is illustrated in U.S. Pat. No. 4,943,211 by Boegh, entitled "Sand filter cleaning system," the contents and teachings which are additionally incorporated herein by reference. Patents that illustrate other background siphon devices, the contents and teachings which are incorporated herein by reference, include U.S. Pat. No. 3,645,452 by Stoeckel et al, entitled "Tank Cleaner;" U.S. Pat. No. 5,133,484 by Globert et al, entitled "Suction tube device;" French patent 2,630,011 by Raigneau, entitled "Apparatus for introducing a clean washing liquid into a container and removing the used liquid by siphoning, in particular for washing the stomach of a patient;" and German patent 4,330,430 by Hini et al, entitled "Installation for the separation and extraction of liquid." Other patents, the contents and teachings which are incorporated herein by reference, illustrate the use of various tools in combination with siphons: U.S. Pat. No. 4,722,670 by Zweifel, entitled "Aquarium pump and cleaning system;" and U.S. Pat. No. 5,152,026 by Scarpine, entitled "Cooling tower cleaning device." Finally, a number of artisans in the heretofore unrelated field of fluid pumps have developed various jet pump technologies, the contents and teachings which are incorporated herein by reference, including: U.S. Pat. No. 5,167,046 by Benson, entitled "Induction vacuum;" U.S. Pat. No. 5,322,222 by Lott, entitled "Spiral jet fluid mixer;" U.S. Pat. No. 5,556,259 by Hlavenka, entitled "Vortex generating fluid injector assembly;" U.S. Pat. No. 6,261,067 by Popov, entitled "Liquid-gas jet apparatus having a predetermined ratio for a cross-section of an active liquid nozzle and a mixing chamber;" U.S. Pat. No. 6,269,800 by Fischerkeller et al, entitled "Device for feeding fuel;" U.S. Pat. No. 6,471,489 by Hua, entitled "Supersonic 4-way self-compensating fluid entrainment device;" U.S. Pat. No. 6,537,036 by Broerman et al, entitled "Flow amplifying pump apparatus;" U.S. Pat. No. 6,547,532 by Gonzalez et al, entitled "Annular suction valve;" U.S. Pat. No. 6,575,705 by Akiyama et al, entitled "Jet pump throat pipe having a bent discharge end;" U.S. Pat. No. 6,783,334 by Sanderson et al, entitled "Hydraulic pump reservoir having deaeration diffuser;" and U.S. Pat. No. 6,904,769 by Ogata et al, entitled "Ejector-type depressurizer for vapor compression refrigeration system."

SUMMARY OF THE INVENTION

Exemplary embodiments of the present invention solve inadequacies of the prior art by providing a water-line connected fresh water source, a divider which splits the fresh water between a siphon primer outlet and a tank flush source line, a spray nozzle terminating the tank flush source line, a siphon tank return line sharing an external wall with or alternatively concentrically arranged about the tank flush source line, a mixing chamber at the junction between the siphon primer outlet and the siphon tank return line, and a drain line. In addition to the basic siphon and jet pump components, flow control valves and various cleaning utensils may be added as desired or required.

In a first manifestation, the invention is a siphon adapted for thoroughly cleaning fluid vessels and containers. The inventive siphon is capable of elevating discharge waste fluid to water heads greater than present in the fluid vessels and containers, and derives the necessary motive power through fluid kinetic energy provided by a pressurized fluid source thereby obviating the need for undesirable electrical, chemical, or other mechanical power sources. In operation the siphon is both intuitive and without unexpected action required, such that persons of diverse experience, knowledge and skill may readily use the apparatus. The siphon has an inlet receiving pressurized fluid from a pressurized fluid source. A divider splits pressurized fluid between a jet port outlet and a tank flush source conduit. A siphon return conduit carries waste fluid from the fluid vessels and containers during operation to a drain conduit. A mixing chamber is provided at a junction between the jet port outlet and an outlet from the siphon return conduit. The jet port outlet is operative when no waste fluid is passing from the siphon return conduit into mixing chamber to induce a siphon-generating flow into the drain conduit. The jet port outlet is also operative when waste fluid is passing from the siphon return conduit into the mixing chamber to introduce a fluid flow of higher velocity than solely within the waste fluid, to thereby transfer kinetic energy into the waste fluid to accelerate the waste fluid into the drain conduit.

In a second manifestation, the invention is an apparatus for cleaning above and within an aqueous body. In this manifestation, a fluid inlet receives a pressurized fluid from a pressurized fluid source. A drain conduit is provided. A tank flush source conduit is coupled with the fluid inlet and is operative to conduct pressurized fluid from a tank flush source conduit inlet adjacent to the fluid inlet to a tank flush source conduit outlet adjacent to the aqueous body. A siphon return conduit is concentrically arranged about the tank flush source conduit for conducting waste fluid from a siphon return conduit inlet adjacent to the aqueous body to a siphon return conduit outlet adjacent to the drain conduit, the tank flush source conduit outlet protruding from the siphon return conduit inlet.

In a third manifestation, the invention is a recreational vehicle water heater cleaning apparatus adapted for thoroughly cleaning recreational vehicle water heaters which is capable of elevating discharge waste fluid to water heads greater than a water head present within the recreational vehicle water heater. The cleaning apparatus derives the necessary motive power through fluid kinetic energy provided by a fluid source and thereby obviates the need for undesirable electrical, chemical, or other mechanical power sources. Further, operation is both intuitive and without unexpected action required such that persons of diverse experience, knowledge and skill may readily use the apparatus. These benefits are made possible by several components. An inlet receives pressurized fluid from the pressurized fluid source. A divider splits the pressurized fluid between a jet port outlet and a tank flush source conduit. A cleaning attachment terminates the tank flush source conduit. A siphon return conduit is concentrically arranged about the tank flush source conduit and is operative to carry waste fluid from the recreational vehicle water heater, with the cleaning attachment originating from within an inlet to the siphon return conduit and protruding therefrom. The spray nozzle operatively blocks the siphon return conduit from being held by siphon vacuum against a surface of the fluid vessels and containers. A drain conduit is provided, as is a mixing chamber at a junction between the jet port outlet and an outlet from the siphon return conduit. The jet port outlet is operative when no waste fluid is passing from the siphon return conduit into the mixing chamber to induce a siphon-generating flow into the drain conduit. The jet port outlet is operative when waste fluid is passing from the siphon return conduit into the mixing chamber to introduce a fluid flow of higher velocity than that of the waste fluid, and thereby transfer kinetic energy into the waste fluid to accelerate the waste fluid into the drain conduit.

OBJECTS OF THE INVENTION

A first object of the invention is to provide an apparatus for thoroughly cleaning a water heater. A second object of the invention is to enable the preferred cleaning apparatus to discharge waste fluid at water heads greater than present in the vessel being cleaned. Another object of the present invention is to provide the necessary motive power to drive the cleaning apparatus through fluid kinetic energy provided by a water source, and thereby obviate the need for undesirable electrical, chemical, or other mechanical power sources. A further object of the invention is to ensure that the operation of the preferred embodiment is intuitive and without unexpected action required, such that persons of diverse experience, knowledge and skill may readily use the apparatus. Yet another object of the present invention is to enable ready customization and adaptation of the present invention for diverse needs or applications.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
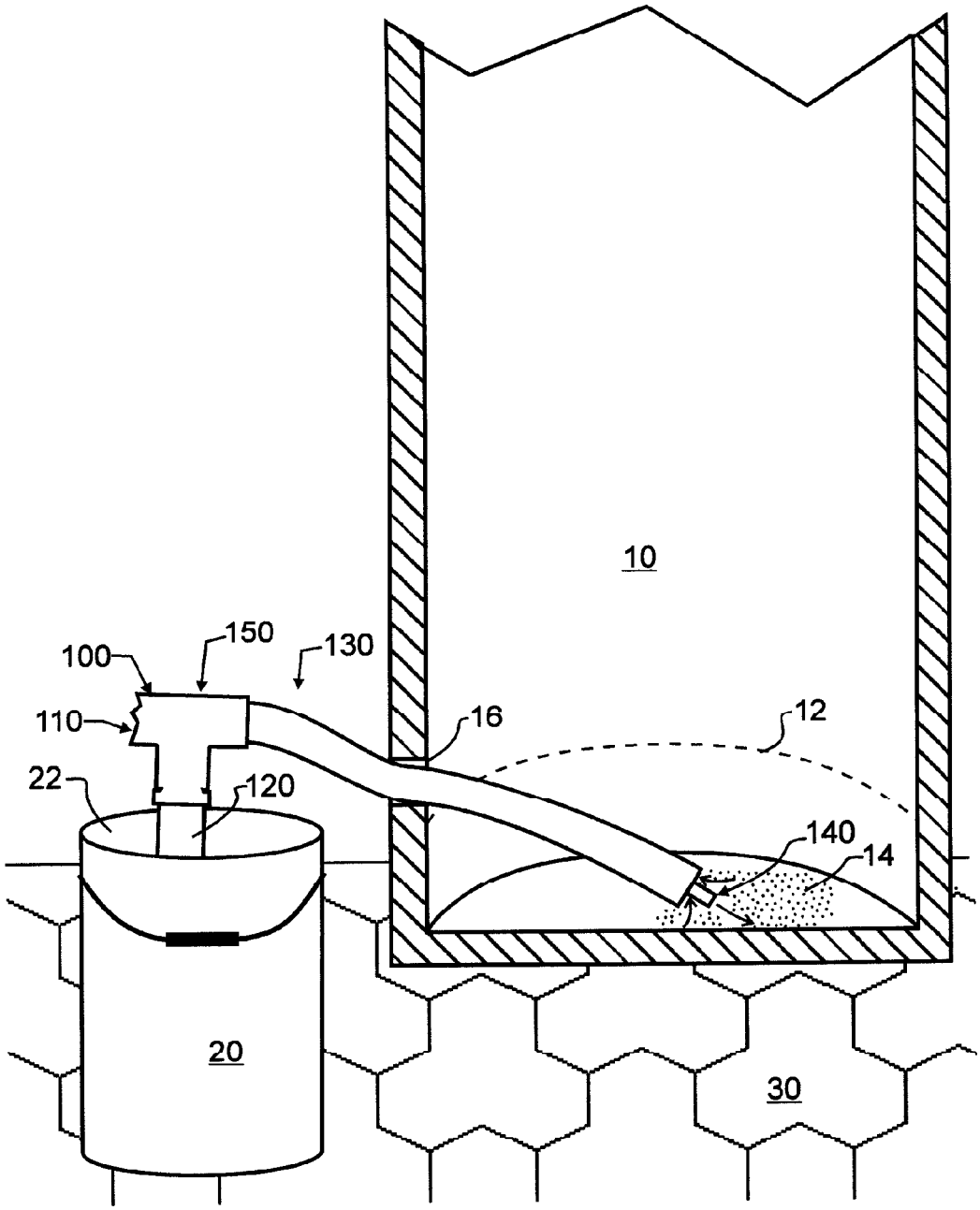
FIG. 1 illustrates a preferred embodiment siphon adapted for cleaning vessels in accord with the teachings of the present invention, in further combination with a water heater and a discharge receptacle, all from a projected generally isometric view. To facilitate a better understanding of the operation, the water heater vessel is shown by cross-section, with other features of the water heater removed for clarity.

A preferred embodiment siphon 100, adapted for cleaning vessels and designed in accord with the teachings of the present invention, is illustrated in FIG. 1. Siphon 100 is illustrated in a preferred further combination operatively cleaning a prior art water heater vessel 10 resting upon floor 30, with siphon 100 drawing from vessel 10 and discharging waste water into a prior art discharge receptacle 20 also resting upon floor 30. Discharge receptacle 20 may, for exemplary purposes only and certainly not limited thereto, take the form of an ordinary pail having a top opening 22. Many other suitable fluid sinks are contemplated herein and known in the art, and again without limiting solely thereto may alternatively or additionally comprise such devices as sinks, plumbing drains, the earthen ground or other ground surface, and other suitable liquid receivers, sinks or receptacles. In some instances, it may further be desirable to filter or otherwise purify the waste water and recycle the water back into inlet 110.

The illustration in FIG. 1 shows water heater vessel 10 containing water therein at an upper level 12 which is just below the level of drain hole 16. The level illustrated may be obtained by ordinary use of drain hole 16, such that a balance of water filling water heater vessel 10 would have been drained by gravity out of vessel 10, either directly spilling therefrom or through some secondary discharge hose or conduit, the likes of which are known and not illustrated herein. In the case of prior art recreational vehicle water heaters, this drain hole 16 may only be approximately one-half inch in diameter, which is too small to permit or facilitate further prior art cleaning or inspection. Rust, scale, and other impurities and matter 14 will ordinarily be suspended within the water, and will also commonly include a substantial amount of sediment.

Siphon hose 130 has been inserted through opening 16. Passing inside of siphon hose 130 is spray hose 140. Most preferably, spray hose 140 extends into vessel 10 just farther than siphon hose 130, such that spray hose 140 protrudes slightly therefrom. By so arranging hoses 130, 140, the inlet to siphon hose 130 cannot be blocked by accidental contact with a surface, which could in the prior art be followed by being held in this blocked position by the vacuum force created by the siphoning liquid. Instead, in the preferred embodiment siphon 100, when hoses 130, 140 approach a wall or floor of vessel 10, the discharge of water from hose 140 will repel hoses 130, 140 away. Consequently, the combination of siphon hose 130 and spray hose 140 with spray hose 140 protruding will facilitate proper movement and use of preferred embodiment siphon 100.

Clean water or other suitable fluid is introduced into siphon 100 at inlet 110, where it is metered and divided between outlet 120 and spray hose 140, as will be explained in greater detail with respect to FIG. 2. Desirably, fluid sprayed from spray hose 140 will interact with matter 14 to entrain and withdraw this matter from vessel 10. Contaminating matter 14 and liquid are drawn into siphon hose 130, pass through junction 150 to outlet 120, and then pass into receptacle top opening 22 to be collected within discharge receptacle 20.

Figure 2:
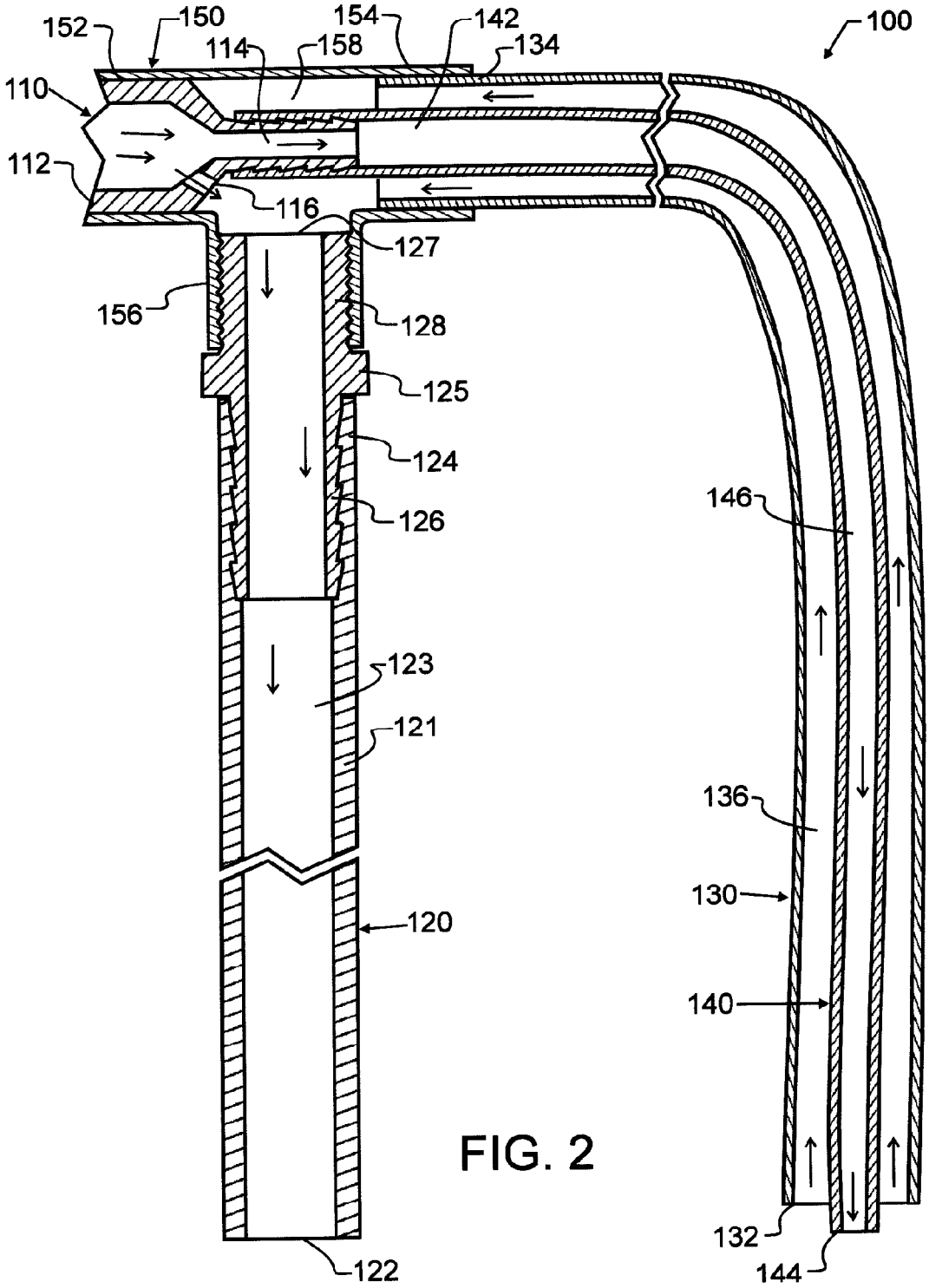
FIG. 2 illustrates the preferred embodiment siphon of FIG. 1 by cross-sectional view taken along a plane approximately dividing the siphon into two symmetrical halves.

FIG. 2 illustrates preferred embodiment siphon 100 of FIG. 1 in much greater detail. Most preferably fluid inlet 110 comprises a means for coupling to a pressurized water inlet. The coupling means in the simplest embodiment is inlet wall 112, which forms a tight friction fit with a suitable tube from a water source. Any of a myriad of other couplings are contemplated herein, which might commonly include such devices as a garden hose terminating in either hose threads or quick release couplings, or any other fluid couplings known in the couplings art. Fluid passing into inlet 110 might commonly include ordinary tap or household water, at typical pressure levels of approximately thirty to sixty pounds per square inch (PSI). While water is described as the preferred fluid of choice, those skilled in the art will recognize that the fluid might alternatively include or be solely composed of other compounds, ranging from RV antifreeze to storage or cleaning solutions, such as but not limited to vinegar and water solutions, phosphoric acid solutions, chlorinated solutions, or others of the many known solutions which are suitable for use in cleaning or otherwise treating potable water supplies.

From adjacent to inlet wall 112, the fluid will divide through two outlet ports. Spray outlet port 114 is of appropriate diameter to couple with inlet 142 in an interior conduit 146 of spray hose 140. Jet port 116 will typically be of smaller diameter, and is used in two ways. The water passing through jet port 116 will serve as an initial primer to initiate a vacuum within outlet 120. In other words, as water or fluid passes through jet port 116 and into the entrance 127 into interior passage 123 of outlet 120, air will naturally be carried therewith. This flow of matter and mass out of passage 123, which is greater than the fluid input through jet port 116, will serve to build a vacuum which will extend into chamber 158. The outlet 134 of siphon hose 130 is directly coupled into chamber 158. Consequently, vacuum will also begin to build within the interior passage 136 of siphon hose 130. Eventually, sufficient vacuum forces will be generated therein to draw fluid into siphon hose 130 through siphon inlet 132, and this fluid will in many cases fill the entire space of interior passage 136.

As this occurs, and chamber 158 similarly fills, the movement of fluid through jet port 116 will begin to interact directly with the fluid passing from interior passage 136 into chamber 158. As a result, this same fluid will be accelerated by kinetic energy transferred from the fluid jet into siphon flow. Consequently, fluid passing through jet port 116 will not only serve to initiate a priming of siphon 100, but this same fluid stream will act as a jet pump through the transfer of kinetic energy. Consequently, once operational, siphon 100 is not only able to act through siphon to transfer fluid from a container of higher surface or head to a container of lower surface or head, as is known in the siphon art, but the present invention is able to transfer from a container of lower surface or head to one of higher surface or head. This is of particular benefit in the case of a water heater that rests immediately adjacent to the ground or other surface, and which has a drain hole only a few inches higher. Rather than only being able to fill a discharge receptacle with a small quantity of the fluid within the water heater, preferred embodiment siphon 100 may fully discharge fluid until siphon hose inlet 132 no longer remains fully submerged, and so instead begins to draw air into siphon hose interior passage 136. If siphon hose inlet 132 is subsequently re-submerged, then the priming and jet pumping process will restart.

Proper selection of the diameter of jet port 116 is important to the successful operation of preferred embodiment siphon 100. The size is a function of the inlet pressure, the available cross-section of siphon hose interior passage 136 and outlet passage 123, and the temperature and associated viscosity of the fluids being used. In the case of water, temperatures above freezing will result in no consequential changes in viscosity, and the preferred apparatus is quite tolerant of pressure variations. Consequently, those skilled in the art, without undue experimentation, will be able to select an appropriate jet port size for use within a siphon designed in accord with the present teachings. Another important factor is the material from which jet port 116 is fabricated. Since size is important to proper operation, it is desirable for a higher quality siphon 100 to include a jet port 116 which is fabricated from a material or alloy which is both reasonably hard or durable and which also exhibits excellent corrosion resistance. The extent of durability and corrosion resistance chosen will depend upon how long a designer wishes the present invention to last, and the expected operating pressures.

Proper orientation of jet port 116 with respect to outlet 120 and chamber 158 is also very important. While not specifically illustrated, a number of means are contemplated herein and known in the industry for obtaining this alignment. The particular means selected may further depend in part upon the methods of fabrication and coupling of each of the components. For exemplary purposes, and not solely limited thereto, inlet 110 may be threaded into junction 150, in which case an alignment mark or the like will preferably be provide on the exposed side of inlet 110 distal to port 114. As another exemplary means, a keyway and associated key may be provided to force alignment between inlet 110 and junction 150, such as the formation of a small slot partially penetrating inlet 110 and a small protrusion extending from junction 150 into this slot. With such arrangement, inlet 110 may only be placed in alignment where the slot and protrusion align, thereby ensuring proper alignment. In this type of arrangement, inlet 110 might for exemplary purposes be press-fit into junction 150 adjacent to junction inlet 152, or may be soldered, welded, adhesively bonded or otherwise rigidly affixed. Just as inlet 110 may be coupled through a myriad of appropriate methods, so exist a myriad of possibilities for the other couplings and junctions illustrated in the present invention. Furthermore, it is contemplated herein that ones of the various components illustrated herein may either be consolidated into a single unitary device, or they may be fabricated from a plurality of discrete components. In either case, the component assembly and methods of affixing are not critical, so long as the finished siphon remains functional. As aforementioned, there are a myriad of other suitable keying or alignment techniques that are known and applicable to the present invention.

An additional coupler 125 is illustrated in the preferred embodiment siphon 100. This is so because it is anticipated that the spatial orientation of siphon 100 may be changed during use to help redirect spray outlet 144 about the interior surfaces of vessels to be cleaned. Nevertheless, outlet 120 will be expected to remain within discharge receptacle 20 or other discharge receptacle. Consequently, to best accommodate this movement, outlet 120 will most preferably include a conduit 121 which is flexible and pliant, such as one fabricated from pliable polymers, elastomers, or rubber-like compounds. In such case, coupling may be readily achieved through many techniques, but the flared barbed end 126 of coupler 125 will in most cases serve to hold the end 124 of conduit 121 distal to outlet 120 termination 122 in place. Likewise, coupler 125 may be securely coupled to junction 150 adjacent junction outlet 156 using a threaded coupling 128 or by any other suitable means.

Figure 3:
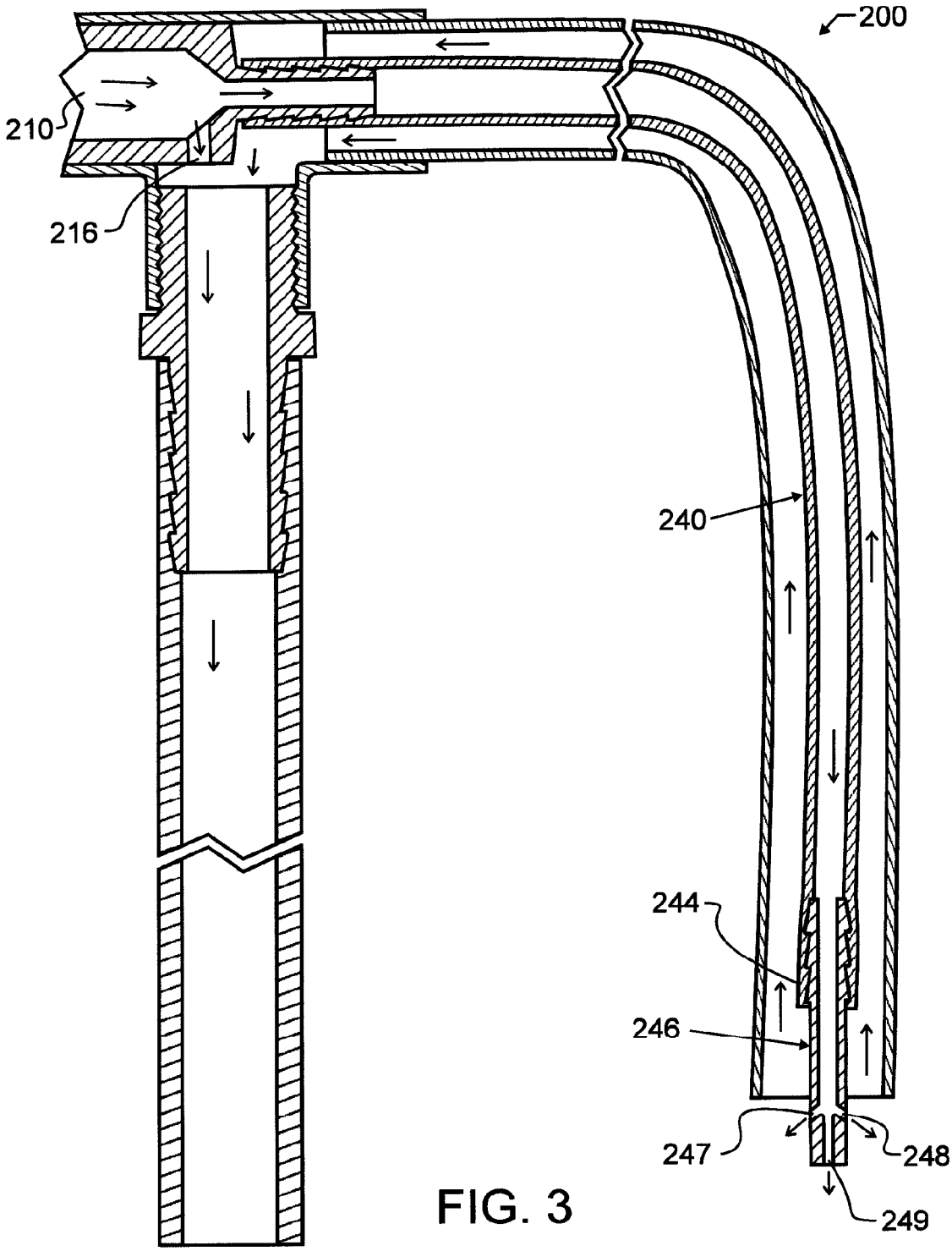
FIG. 3 illustrates a first alternative embodiment siphon adapted for cleaning vessels in accord with the teachings of the present invention by cross-sectional view taken along a plane approximately dividing the siphon into two symmetrical halves.

A first alternative embodiment siphon 200 adapted for cleaning vessels in accord with the teachings of the present invention is illustrated in FIG. 3. For sake of brevity, components which are like in geometry and function to those illustrated in the preferred embodiment siphon 100 will not be numbered or separately discussed. Nevertheless, for this and the subsequent alternatives, it will be understood that these components are in fact present and function as already described herein above.

In siphon 200, two noteworthy changes have been made. The first change is to inlet 210, which differs from inlet 110 by the placement and orientation of jet port 216 relative to outlet entrance 127. More particularly, jet port 216 will direct high pressure fluid directly into and parallel with outlet passage 123, thereby fully preserving the kinetic energy of the fluid flowing through jet port 216. Whether such kinetic energy remains primarily with that fluid and adjacent entrained air, or whether the kinetic energy is transferred into a siphon flow originating at siphon inlet 132 depends upon whether siphon 200 has been primed, and fluid is being conveyed from siphon inlet through to adjacent jet port 216. Nevertheless, less kinetic energy is lost in siphon 200 than in siphon 100.

The second noteworthy change illustrated in FIG. 3 is in the arrangement and geometry of the spray outlet. In contrast to simple tubular spray outlet 144, spray tip 246 is held within a termination 244 of spray hose 240 by barbs or similar suitable means. Termination 244 is within the confines of siphon hose 130, but spray tip 246 most preferably extends beyond inlet 132 of siphon hose 130, for the same reasons as did spray outlet 144. Rather than a single tubular stream or jet, spray tip 246 is configured for at least three jets, emanating from jet outlets 247-249. While three smaller jet outlets are shown, it will be recognized that any suitable geometry may be provided within spray tip 246, and that a plurality of tips may be designed for different functions or capabilities. Further, one or more of a variety of cleaning attachments such as brushes, squeegees or the like may be coupled within termination 244 or formed in association with spray tip 246, the specific geometries which are taught for example by the Scarpine patent and others incorporated herein above by reference.

Figure 4:
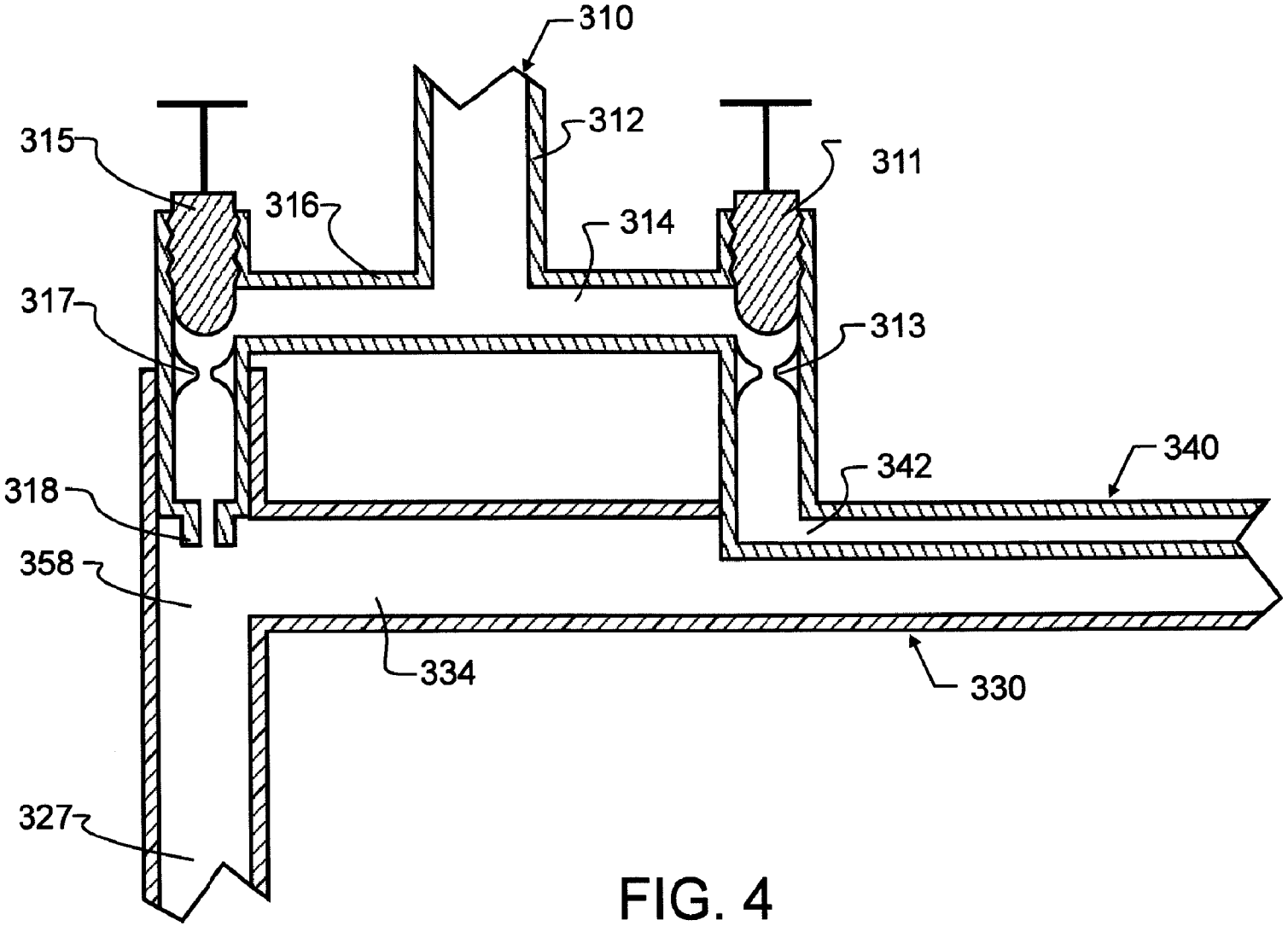
FIG. 4 illustrates a second alternative embodiment source water flow control by enlarged partial cross-sectional view taken along a plane approximately dividing the water flow control into two symmetrical halves.

FIG. 4 illustrates a second alternative embodiment source water flow control by enlarged partial cross-sectional view, such that siphon hose 330 and spray hose 340 are only visible in small part adjacent to inlet 310, and the entrance 327 to outlet 120 is visible, while outlet 120 is not. In this second alternative embodiment, fluid inlet 310 is divided between ports 314 and 316, but neither of these ports is limited to a small enough diameter to generate a jet therefrom. Instead, port 314 passes valve body 311 and valve seat 313 into spray hose inlet 342 of spray hose 340. Fluid entering port 316 will similarly pass valve body 315 and valve seat 317, before being expelled from jet port 318. Most preferably, jet port 318 is sufficiently small relative to the opening defined by valve seat 317 that, when desired, the pressure developed on the side of jet port 318 adjacent to seat 317 will build to nearly the pressure at fluid inlet 310. In this way, valve seat 317 will not act as a detrimental flow restriction. Otherwise, valve seat 317 will reduce the kinetic energy being transferred by fluid passing through jet port 318. From jet port 318, fluid will pass into inlet 327, from where it will most preferably couple coaxially with outlet 120 for discharge therefrom. Valve bodies 311, 315 may each separately be adjusted, allowing a person to control both the amount and pressure of spray fluid emanating from a spray house outlet such as spray outlet 144 and also to control the priming and extent of jet pumping from jet port 318. As but one example, when valve body 311 is closed, fluid will cease to be delivered into the fluid vessel. Nevertheless, the siphoning action persists, and any fluid within the vessel such as 12 illustrated in FIG. 1 may be drained. Particularly in those vessels where the bottom is lightly bowl-shaped or concave, remaining fluid will collect in the center of the bottom. In such case, it may be possible to remove almost all of the fluid from within the vessel. The vessel may be left in this state, or, if the operator so elects, valve 311 may once more be opened to run through another cleaning cycle.

An alternative embodiment arrangement of spray and siphon hoses is also illustrated in FIG. 4. More particularly, while the previous embodiment hoses 130, 140 were illustrated as being generally co-axial, with spray hose 140 of smaller cross-sectional area than siphon hose 130, the co-axial arrangement is not necessary to the operation or functioning of the present invention. Nevertheless, it is most preferable to incorporate a smaller spray hose 140 within the cross-section of a larger siphon hose 130, or to at least share a common exterior wall with at least a portion of the exterior of spray hose 140 serving as a portion of the interior surface defining siphon hose interior passage 136. In this way, the limited cross-sectional area which is available in RV water heaters and in other applications will be most efficiently utilized by apparatus designed in accord with the teachings of the present invention. In the case of this figure, it is also conceived herein that spray outlets may be provided at any point and in any suitable pattern and size along the length of spray hose 340 as may be desired.

The specific materials used in the fabrication of the various components within siphon 100 are generally not critical to the invention. Where importance has been given to the selection of materials, some suitable materials have been identified. Nevertheless, it will be obvious to one skilled in the art, upon a review of the present disclosure, to substitute other materials. Furthermore, the components as identified herein do not have to be fabricated in as few or as great a count as shown. Instead, several components may be fabricated as a single integral unit, or one component illustrated may be fabricated from several, as the needs of manufacturing become known for a particular design. Such substitutions are contemplated herein, in consideration with the functions which are outlined herein above.

As aforementioned, a number of different chemical compositions are contemplated for use herein. Exemplary of these, but not solely limited thereto, are RV antifreeze, other storage solutions, and cleaning and treatment solutions such as vinegar and water solutions, phosphoric acid solutions, chlorinated solutions. Rather than supply such cleaning solutions to both inlet 142 and jet port 116, in some instances it may be desirable to introduce this solution solely to inlet 142. In such case, a separate injector, metering device, venturi, or other suitable means may be provided subsequent to the division of pressurized fluid and adjacent to or even within spray hose 140, through which additional ingredients may be introduced.

Consequently, while the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. An apparatus for cleaning above and within an aqueous body, comprising:

a fluid inlet receiving a pressurized cleaning fluid from a pressurized fluid source;

a drain conduit receiving waste fluid from said aqueous body and discharging said waste fluid externally therefrom;

a tank flush source conduit coupled with said fluid inlet and operative to conduct said pressurized cleaning fluid from a tank flush source conduit inlet adjacent to said fluid inlet to a tank flush source conduit outlet distal to said fluid inlet and within said aqueous body; and a siphon return conduit concentrically arranged about said tank flush source conduit for conducting said waste fluid from a siphon return conduit inlet opening within and generally surrounded by said waste fluid in said aqueous body to a siphon return conduit outlet adjacent to said drain conduit, said tank flush source conduit outlet protruding from said siphon return conduit inlet and conducting said pressurized cleaning fluid into said aqueous body simultaneously with said siphon return conduit inlet conducting said waste fluid out of said aqueous body, wherein said tank flush source conduit is the most protrusive structure of said cleaning apparatus into said aqueous body during said conducting of fluid.

2. The apparatus for cleaning above and within an aqueous body of claim 1, further comprising:

a divider which splits said pressurized fluid into first and second simultaneous fluid streams, said first fluid stream flowing to a jet port outlet and said second fluid stream flowing to said tank flush source conduit; and a mixing chamber at a junction between said jet port outlet and an outlet from said siphon return conduit, said jet port outlet first fluid stream operative when no waste fluid is passing from said siphon return conduit into said mixing chamber to induce a siphon-generating flow into said drain conduit and said jet port outlet first fluid stream operative when waste fluid is passing from said siphon return conduit into said mixing chamber to introduce a fluid flow of higher velocity than within said waste fluid prior to mixing therewith and thereby transfer kinetic energy into said waste fluid to accelerate said waste fluid into said drain conduit, said jet port outlet first fluid stream aligned parallel with said waste fluid flow in said drain conduit.

3. The apparatus for cleaning above and within an aqueous body of claim 1, wherein said tank flush source conduit further comprises a cleaning attachment removable from and terminating said tank flush source conduit.

4. The apparatus for cleaning above and within an aqueous body of claim 3, wherein said additional cleaning attachment further comprises a spray nozzle.

5. The apparatus for cleaning above and within an aqueous body of claim 4, wherein said spray nozzle originates from within an inlet to said siphon return conduit and protrudes therefrom, wherein said spray nozzle blocks said siphon return conduit from being held by siphon vacuum against a surface of said fluid vessels and containers.

6. The apparatus for cleaning above and within an aqueous body of claim 2, further comprising a flow control valve between said jet port outlet and said divider which restricts flow from said inlet to said jet port outlet, thereby enabling an operator to control both a priming of said siphon and to control an extent of said kinetic energy transfer.

7. The apparatus for cleaning above and within an aqueous body of claim 2, further comprising a flow control valve between said tank flush source conduit and said divider which restricts flow from said inlet to said tank flush source conduit, thereby enabling an operator to control a flow of fluid into said fluid vessels and containers.

8. The apparatus for cleaning above and within an aqueous body of claim 2, wherein said fluid vessels and containers comprise a recreational vehicle water heater, and said kinetic energy transfer is operative to elevate a head of said waste fluid above a head of fluid within said recreational vehicle water heater, thereby facilitating cleaning and removal of said fluid within said recreational vehicle water heater.

9. The apparatus for cleaning above and within an aqueous body of claim 2, wherein said waste fluid further comprises waste cleaned from said aqueous body.

10. A recreational vehicle water heater cleaning apparatus adapted for thoroughly cleaning recreation vehicle water heaters which is capable of elevating discharge waste fluid to water heads greater than present in said recreational vehicle water heaters, which derives the necessary motive power through fluid kinetic energy provided by a fluid source and thereby obviates the need for undesirable electrical, chemical, or other mechanical power sources, and which operation is both intuitive and without unexpected action required such that persons of diverse experience, knowledge and skill may readily use the apparatus, comprising:

an inlet receiving pressurized cleaning fluid from said pressurized fluid source;

a divider which directs said pressurized cleaning fluid simultaneously to both a jet port outlet and a tank flush source conduit;

a cleaning attachment terminating said tank flush source conduit with a spray nozzle;

a siphon return conduit concentrically arranged about said tank flush source conduit and operative to carry waste fluid from said recreational vehicle water heater to a discharge external to said recreational vehicle water heater, said cleaning attachment originating from within an inlet to said siphon return conduit and protruding therefrom, wherein said spray nozzle is the most protrusive structure of said cleaning apparatus into said recreational vehicle water heater while operatively discharging a fluid, and wherein said spray nozzle operatively discharges said cleaning fluid within said recreational vehicle water heater at the same time that said siphon return conduit discharges said waste fluid from said recreational vehicle water heater, said cleaning attachment thereby blocking said siphon return conduit from being held by siphon vacuum against a surface of said fluid vessels and containers;

a drain conduit; and a mixing chamber at a junction between said jet port outlet and an outlet from said siphon return conduit, said jet port outlet having a fluid flow direction aligned parallel to an inlet into said drain conduit and operative when no waste fluid is passing from said siphon return conduit into said mixing chamber to induce a siphon-generating flow into said drain conduit and said jet port outlet operative when waste fluid is passing from said siphon return conduit into said mixing chamber to introduce a fluid flow of higher velocity than a velocity of said waste fluid absent said jet port outlet and thereby transfer kinetic energy into said waste fluid to accelerate said waste fluid into said drain conduit.

11. The recreational vehicle water heater cleaning apparatus of claim 10, further comprising a flow control valve between said jet port outlet and said divider which restricts flow from said inlet to said jet port outlet, thereby enabling an operator to control both a priming of said siphon and to control an extent of said kinetic energy transfer.

12. The recreational vehicle water heater cleaning apparatus of claim 10, further comprising a flow control valve between said tank flush source conduit and said divider which restricts flow from said inlet to said tank flush source conduit, thereby enabling an operator to control a flow of fluid into said fluid vessels and containers.

13. The recreational vehicle water heater cleaning apparatus of claim 10, wherein said waste fluid further comprises waste cleaned from said recreational vehicle water heater.

* * * * *